United States Patent [19]

Fukuda et al.

[11] 4,323,604

[45] Apr. 6, 1982

[54] CONTINUOUS DIP-PLATING PROCESS ON ONE-SIDE OF STEEL STRIP

[75] Inventors: Shuzo Fukuda; Yutaka Ohkubo, both of Yokohama, Japan

[73] Assignee: Nippon Kokan Kabushiki Kaisha, Tokyo, Japan

[21] Appl. No.: 158,630

[22] Filed: Jun. 11, 1980

[30] Foreign Application Priority Data

Jun. 1, 1979 [JP] Japan ..... 54-67445
Dec. 6, 1979 [JP] Japan ..... 54-158635

[51] Int. Cl.[3] ..... C23C 1/02; C23C 7/00

[52] U.S. Cl. ..... 427/433; 204/15; 427/434.3

[58] Field of Search ..... 204/15, 28; 427/433, 427/434.3, 434.5, 422, 424, 300

[56] References Cited

U.S. PATENT DOCUMENTS

| | | | |
|---|---|---|---|
| 4,072,581 | 2/1978 | Allen | 204/15 |
| 4,102,772 | 7/1978 | Nakamura | 204/15 |
| 4,254,158 | 3/1981 | Fukuzuka | 427/434.3 |

FOREIGN PATENT DOCUMENTS

| | | | |
|---|---|---|---|
| 2656524 | 6/1978 | Fed. Rep. of Germany | 427/300 |
| 54-125136 | 9/1979 | Japan | 427/434.3 |
| 54-128442 | 10/1979 | Japan | 204/15 |

*Primary Examiner*—T. M. Tufariello
*Attorney, Agent, or Firm*—Moonray Kojima

[57] ABSTRACT

A uniform plating treatment is carried out on one-side of a steel strip in that the strip is travelled horizontally over a still surface of a plating bath while the plating bath is jetted onto the one-side of the strip, and the one-side is positively given on its edges a plating flow running in width of the strip outwardly from the edges and the other part except the edges is given the plating flow running in length of the strip.

3 Claims, 13 Drawing Figures

CONTINUOUS DIP-PLATING PROCESS ON ONE-SIDE OF STEEL STRIP

BACKGROUND OF THE INVENTION

The invention relates to a process and an apparatus for exactly and uniformly plating molten metal on a one-side of steel strip.

Industrial fields relative with automobile commercial world have recently desired such steel sheets treated with plating only on one-side thereof, i.e., so called one-side plated steel sheets, and there have been proposed many processes concerning this manufacturing technique. Typical examples are known as the exfoliating-agent coating process, the meniscus process, the one-side electrolizing process, the one-side grinding process or the supersonic plating process.

The exfoliating-agent coating process coats the exfoliating agent such as water glass on one side of the strip, plates on the other side on the dip-plating line, and brushes off the agent. But this process is involved with a problem requiring the coating of the exfoliating agent and the brushing off mechanism to reduce the working efficiency, besides the complicated processing steps.

The meniscus process is known by the Japanese Patent Laid Open No. 52-134826 (laid open to the public inspection in 1977) in which the plating is performed by contacting one side of the strip to the surface of the molten metal, utilizing the surface tension, and it has been said that this process could be reduced to the practice with more or less alternations to the existing facilities, however the rolls holding the strip is dirtied with the plating liquid at the same time of plating the one side, and the strip could not be travelled too fast.

The one-side electrolizing process performs the dip-plating of difference in the plated layer, and electrolytically exfoliates the thinner plated layer. This is rational but expensive in preparing the facilities.

The one-side grinding process plates on both sides in the usual process and mechanically removes the plated layer from one side with the brushing roll equipped on the in-line or the off-line. However, there are disadvantages in the life of the brushing roll or inferiority on the sheet surface after brushing.

The supersonic plating process is known by the Japanese Patent Laid Open No. 53-16327 (laid open to the public inspection in 1978) in which the strip is horizontally travelled 2 to 4 mm above the surface of the plating bath and the supersonic wave is ignited by a supersonic pendulum to its tip via a horn or bar connected to the supersonic pendulum which has almost the same surface as the still surface of the dip-plating bath, so that the tip is effected with the supersonic vibration to upheave the bath surface and contact the plate liquid to the one-side of the strip. However, the upheaval of the liquid surface by the supersonic wave is only around 2 to 4 mm and could not stand for changings of the shapes of the travelling strip or the vibration in the actual line.

In view of these circumstances, the attention has been nowadays paid to such a method which upheaves the surface of the plating bath by means of the pumps to contact it to the surface of the strip, and one of the examples is the Japanese Patent Laid Open No. 53-75124 (laid open to the public inspection in 1978) in which basically the bath surface is swollen in arch to which the travelling strip is contacted at its one side, however it is actually difficult to appropriately cause the plating bath to contact to the edges of the strip only by swelling the bath surface in the width of the strip, and as described in the same the protective gas is blown from the upper direction of the strip in order to avoid invasion of the plating bath to the other surface of the strip at the edges. Therefore, the cost for the facilities and the operation becomes expensive, accordingly.

According to this process, the wet length of the molten Zn and the strip manages the contacting time of Zn and the strip, and this contacting time plays an important role as reacting time at the dip-Zn plating. However, according to the prior art as above mentioned, the wet length obtained by one nozzle is only about 3 to 5 times of the width of the nozzle. For example, in a case of a nozzle having a slit of 10 mm in width, the wet length is only about 30 to 50 mm. That is, if realizing a reaction time corresponding to the reaction time of the continuous Zn plating line on the both sides, it is necessary to make the line speed extremely slow or install a plurality of the nozzles in a line direction. But the former reduces the production and the latter makes considerably large the amount of all exhausting Zn uneconomically, and further difficult problems are present in maintenance.

The present invention has been devised in view of such background of the prior art.

It is a primary object of the invention to perform a uniform and beautiful plating on one side of the strip without invasion of the molten metal to the other side not requiring the plating.

It is another object of the invention to lengthen the wet length in order to make the reaction time longer for plating the molten metal and heighten the supplying efficience of the molten metal.

It is a further object of the invention to follow changings of the width and length of the strip for providing the exact one-side plating.

Other objects and features of the invention will be apparent from description of preferred embodiments of the invention in referrence to the attaching drawings.

DETAILED DESCRIPTION OF PREFERRED EMBODIMENTS

Actual embodiments of the invention will be described in reference to the attaching drawings. In FIGS. 1 to 4, the numeral 1 is a plating chamber, 2 is a plating bath, 2*a* is a still surface of the plating bath, and 3 is a strip which is travelling horizontally with space with respect to the still surface 2*a* (the strip may travel downwardly or upwardly in FIG. 1).

Figure 3:
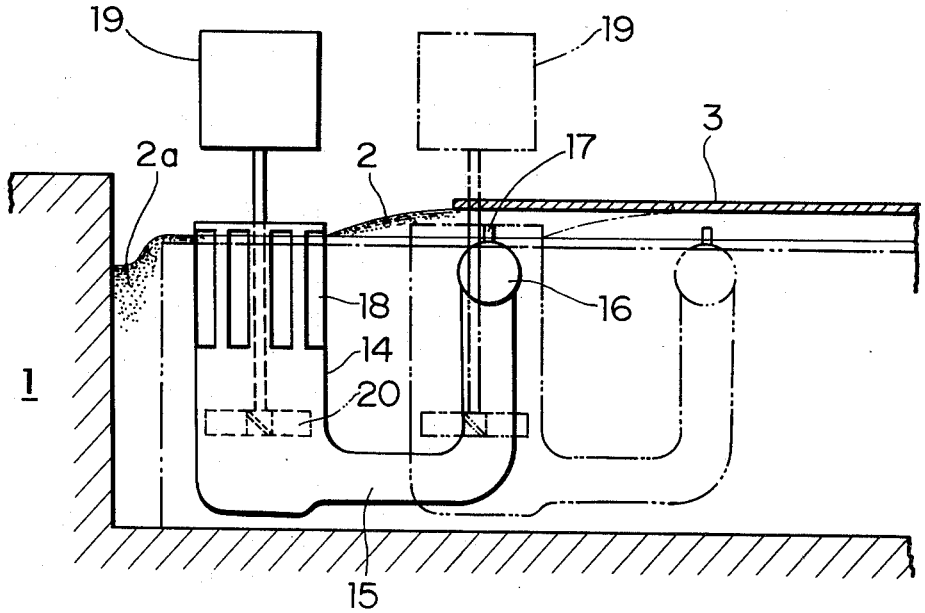
FIG. 3 is a cross sectional view seen from A—A line in FIG. 1.
Figure 4:
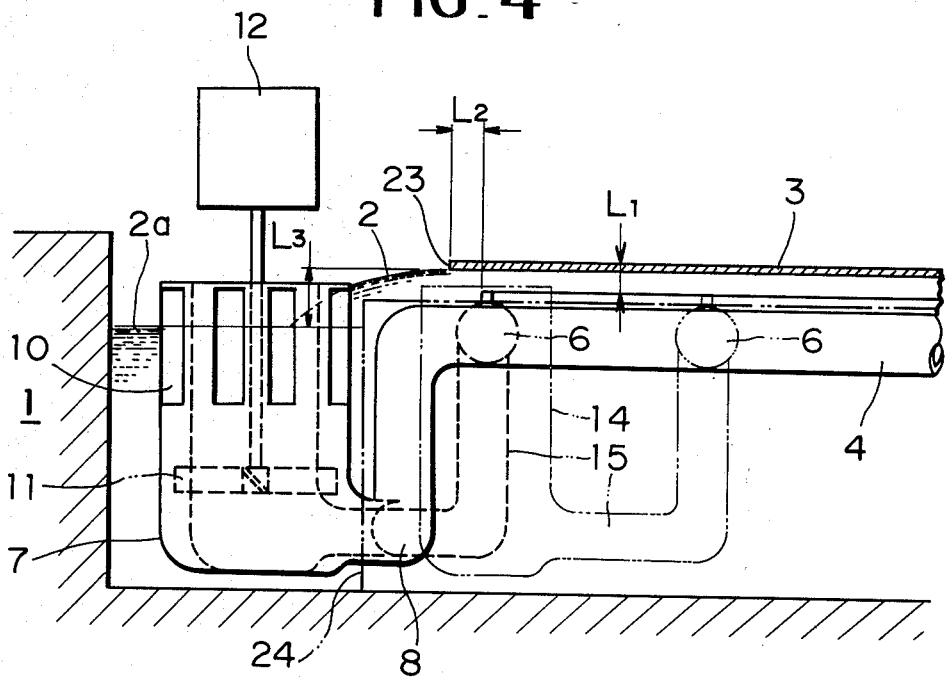
FIG. 4 is a cross sectional view seen from B—B line in FIG. 1.

There are within the plating chamber 1 provided a center nozzle 4 extending in the width of the strip 3 and edge nozzles 6 extending in the length of strip edges. A center nozzle 4 is fed at its header 9 with the bath 2 via a conduit 8 from a pump 7 installed nearly to a side wall of the plating chamber 1. The pump 7 is, as shown in FIG. 4, provided with a plurality of absorbing holes 10 at upper part in the circumferential direction, and an impeller 11 is rotated by a motor 12 to take in the plating bath 2 via the absorbing holes 10, and this bath is spouted out from a slit 13 through the conduit 8 and the header 9. The edge nozzle 6 is, as shown in FIG. 3, fed at its header 16 with the plating bath 2 via a conduit 15 from a pump 14 installed nearly to the side wall of the plating bath 1, and this bath is spouted out from a slit 17. The pump 14 herein is also opened at absorbing holes 18 at upper part, similarly as the pump 7 of the center nozzle, and is provided with an impeller 20 which is rotated by a motor 19.

Figure 1:
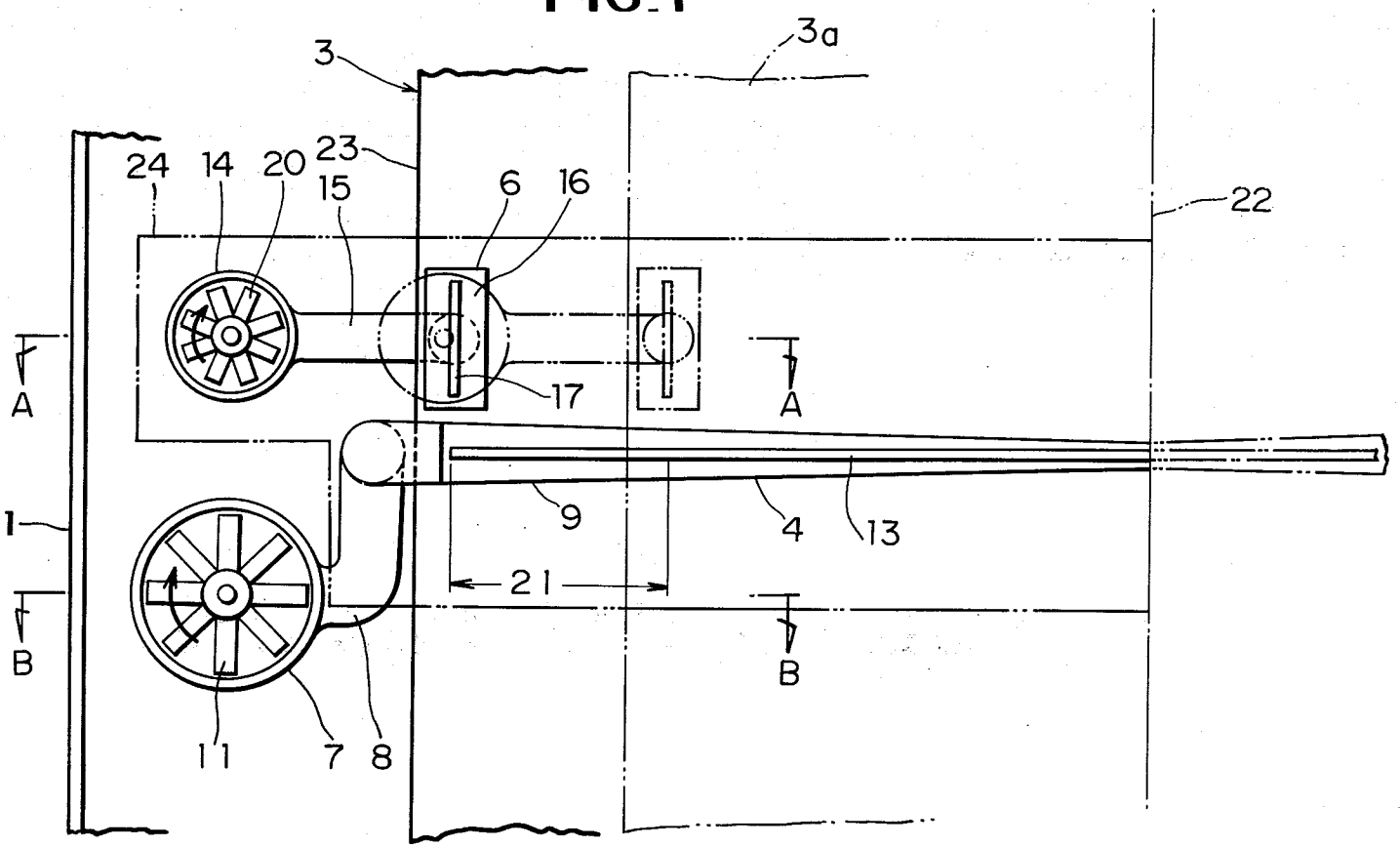
FIG. 1 is a plan view, in section of the right half, showing one example of an apparatus for effectively practising the process of the invention.
Figure 2:
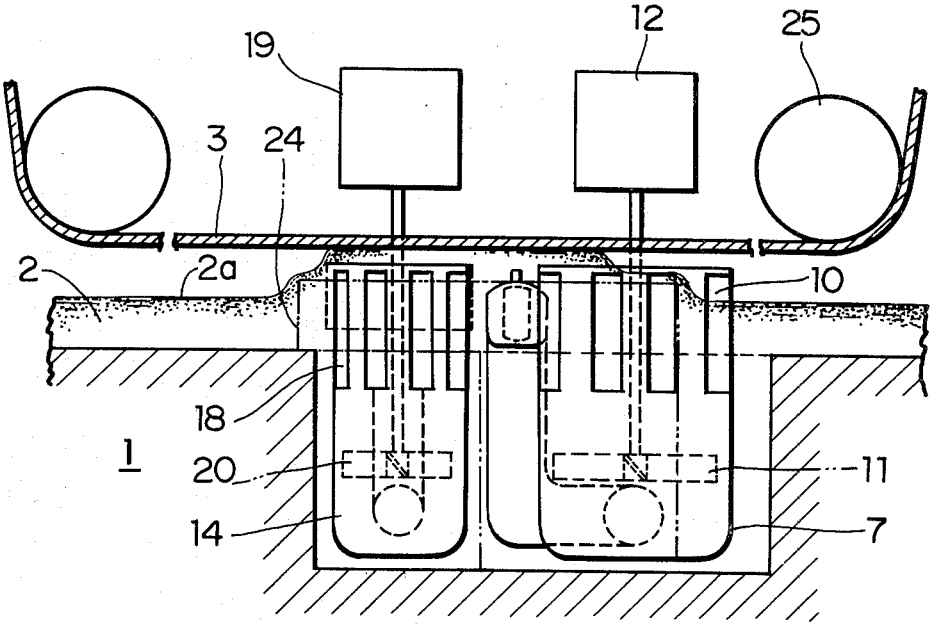
FIG. 2 is a side view of the above.

It is necessary for the center nozzle 4 and the edge nozzles 6 to change the jetting positions in accordance with widths of the strips. Due to such an actual demand, the present invention makes the edge nozzles 6 movable in width of the strip together with the pump 14 or by expanding or contracting the conduit 15 (detailed mechanism thereof is not shown). For example as shown in FIG. 1, if the width of the strip is 1270 mm, the edge nozzles 6 are set at solid line and if the width of the strip 3*a* is 920 mm, the nozzles are moved to phantom line. In the latter case, an extra part 21 of the slit of the center nozzle 4 may be covered with a slidable shelter (not shown).

As is seen in the present embodiment in FIG. 1, the header 9 of the center nozzle 4 becomes narrower in diameter as advancing toward a center 22 in order to promise a uniform jetting pressure over the width of the strip.

Such an apparatus is greatly characterized in that the edge nozzles 6 and the center nozzle 4 are more or less above the still surface of the plating bath at their headers. That is, in the prior art, an end of the nozzle is in general under the surface, and if the plating bath is spouting from the outlet of the nozzle in such a condition, the bath around the outlet of the nozzle is swollen to cause so-called accompanying flow. Thereby a resistance by the accompanying flow is added so that the height of jetting is not sufficiently maintained and accordingly the jetting force of the nozzle must be heightened. Therefore, in the invention, the end of the nozzle is projected above the still surface 2*a* of the bath.

It is preferable in the invention that the ends of the headers of the edge nozzles 6 and the center nozzle 4 are 10 to 30 mm above the still surface of the bath. A reason is why the height of less than 10 mm causes said accompanying flow, and that of more than 30 mm makes splashes owing to large dropping difference and stains the other face of the strip not requiring the plating. It is further preferable that a space ($L_1$) between the face of the strip 3 and the headers of the respective nozzles 4, 6 is 10 to 30 mm, since the strip 3 usually travels at flutterings of around ±5 mm and the space ($L_1$) of at least more than 10 mm is required so as to avoid scratches caused in that the strip 3 contacts the header ends of the nozzles 4, 6, but if it is more than 30 mm, the colliding range of the bath to the strip face is too widened, and especially the bath jetted from the edge nozzles 6 invades to the other strip face.

In another embodiment shown in FIG. 4, a space ($L_2$) between the slit 17 and an edge 23 of the strip 3 is around 30 mm, and the strip 3 travels at a space of around 50 mm from the still surface.

Figure 5:
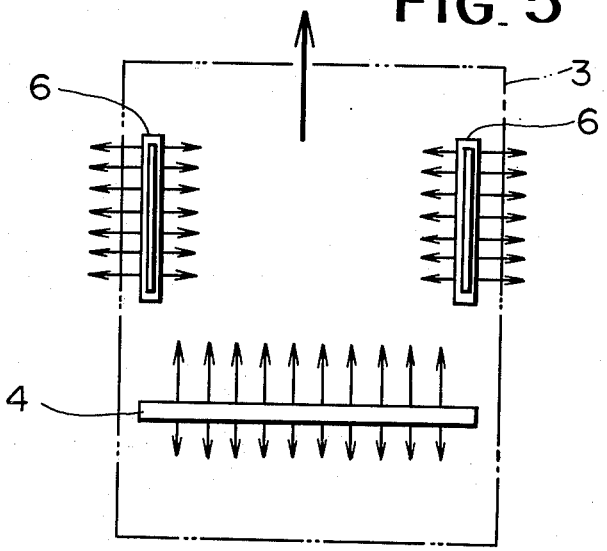
FIG. 5 is an explanatory view showing flowing directions of jetted plating bath in the invention.

A next reference will be made to an actual plating process according to the present apparatus. The strip 3 passed through a heating-reducing step and conveyed within a plating apparatus filled with the atmospheric gas, travels as being supported by horizontal rolls 25 horizontally with respect to the still surface 2*a* of the plating bath in the chamber 1. The plating bath 2 is spouted from the center nozzle 4 and the edge nozzles 6. The bath 2 from the center nozzle 4 collides with the center part of the strip and flows along the length of the strip. The bath 2 from the edge nozzles 6 collides with the edges of the strip 3 and flows in widths of the strip as shown in FIG. 5. The bath flowing outwardly drops into the bath in the plating chamber 1 in parabola as shown in FIGS. 3 and 4.

A problem herein is a flowing speed for obtaining an ideal flow. According to one of the embodiments of the invention, in a case of the edge nozzle 6, if it is positioned at ($L_1$)=20 mm and ($L_2$)=30 mm, and the flowing speed from the nozzle is more than 1.2 m/sec, preferably more than 1.8 m/sec, the bath 2 can spout from the strip edge 23 in satisfied condition without invasion to the other face. Also with respect to the center nozzle 4, if the flowing speed is determined more than 1.2 m/sec with ($L_1$)=20 mm, the uniform and adhesive plating can be provided on the central part of the strip 3. Therefore, appropriate designs will be made to the size of the slits of the nozzles 4, 6, the headers 9, 16 and the pumps 7, 14 in order to provide the flowing speed as mentioned above. In the invention, it is preferable the flowing speed from the edge nozzle 6 is made faster 1.5 to 2.0 times of that from the center nozzle 4 in order to perfectly avoid the invasion to the non-plating face.

As is seen an under table 1, when the flowing speed from the center nozzle 4 is 1.2 m/sec and if the flowing speed from the edge nozzle 6 is 1.5 times thereof, an improvement is found on the uniformability of the plated layer and the responsibility to variations of the strip pass line. If the flowing speed is more than twice of that of the center nozzle, the face not to be plated and the rolls are dirtied. In the table 1, (b) and (c) are dirties by splashes and (d) are dirties by plating interruption and overhanging.

TABLE 1

| | x | | | | | |
|---|---|---|---|---|---|---|
| y | 1.0 | 1.2 | 1.8 | 2.0 | 2.4 | 3.0 |
| a. Uniformability of plated layer | X | Δ | ◎ | ◎ | ◎ | ◎ |
| b. Dirties on non-plated face | ◎ | ◎ | ◎ | ◎ | ○ | Δ |
| c. Dirties on rolls | ◎ | ◎ | ○ | ○ | ○ | Δ |
| d. Responsibility to varia- | | | | | | |

TABLE 1-continued

| y | x 1.0 | 1.2 | 1.8 | 2.0 | 2.4 | 3.0 |
|---|---|---|---|---|---|---|
| tion of strip pass line | X | Δ | ◎ | ◎ | ◎ | ◎ |

Note:
x: Flowing speed at edge nozzle (m/sec)
y: Characteristics
X: Bad
Δ: Slightly bad
○: Average
◎: Good The strip 3 treated with the plating on its one side is controlled at an exit of the plating apparatus in the amount of adhering the plate and is conveyed to a subsequent stage.

As shown with "24" in FIGS. 1 to 4, the invention may incorporate a method, for heightening the operationability, where a pool 24 is, necessary, formed just under the horizontal part of the strip in the plating chamber 1, and the plating bath 2 in the chamber 1 is circulated and supplied into the pool 24 to overflow the bath 2 so that the space is made large between the rolls and the still surface to avoid spoils on the rolls.

Figure 6:
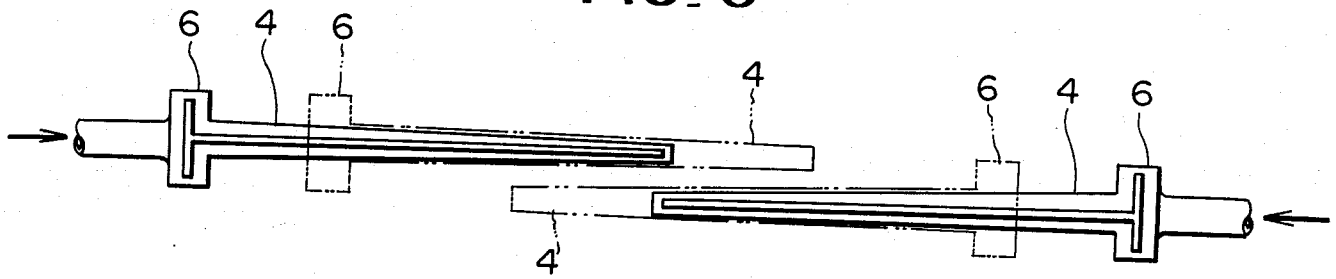
FIG. 6 and FIG. 7 are plan views showing another embodiment of a nozzle to be used in the invention.
Figure 7:
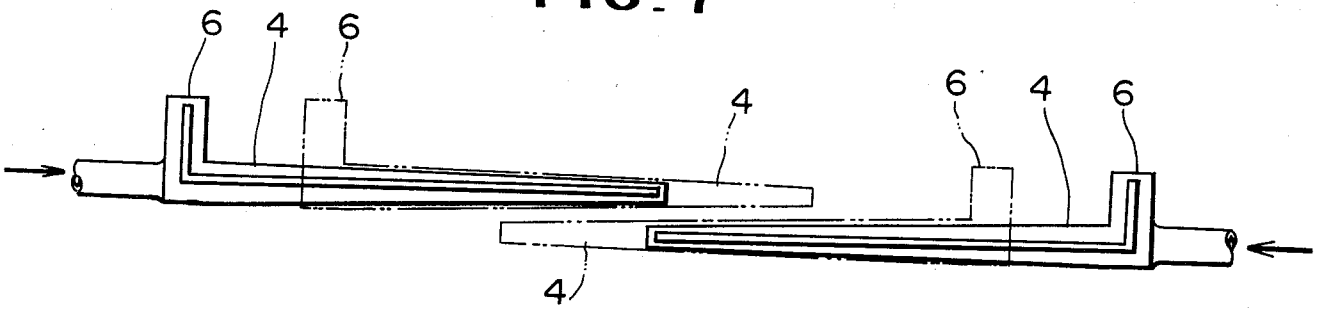

FIGS. 6 and 7 show another embodiment of plating bath jetting nozzles of the invention. The nozzle in FIG. 6 is constituted in T-shape with the center nozzle 4 and the edge nozzle 6 integrally. In FIG. 7, an entire nozzle is constitutes in L-shape. In these embodiments, the right and left nozzles are movable in the width of the strip as shown with phantom lines (detailed mechanism is not shown).

The present embodiment uses the slit nozzle, but as far as obtaining the determined flowing direction, nozzles of other types may be used, or the edge nozzle 6 may be positioned at the interior of the strip edge, biassing toward the outside.

An under table 2 shows comparisons between the present invention in the above mentioned embodiments and comparative examples.

TABLE 2

| | Comparative example e | f | Invention g h |
|---|---|---|---|
| Uniformability of plated layer | Δ | ○ | ◎ |
| Dirities on on non-plated face | ○ | X | ◎ |
| Dirties on rolls | ○ | X | ○ |
| Responsibility to variation of strip pass line | X | ○ | ◎ |

Note:
Nozzle in width direction: Positioned in width equal to width of strip
Marks: Same as in Table 1
e: Using nozzles in width direction only (flowing speed: 4.0m/sec)
f: using nozzles in width direction only (flowing speed: 4.0m/sec)
g: Center nozzle (flowing speed: 1.2m/sec)
h: Edge nozzles (flowing speed: 1.8m/sec)

As is seen from the above table, in comparison with the case that the jetting nozzles are provided only to the width of the strip, the invention can uniformly carry out the plating on the entire one side of the strip, especially on the edges, and since the plating bath does not turn over to the non-plating face, no spoil is marked thereon, and the invention can follow the edge wave, or the center buckling or middle waviness of the strip.

Figure 8:
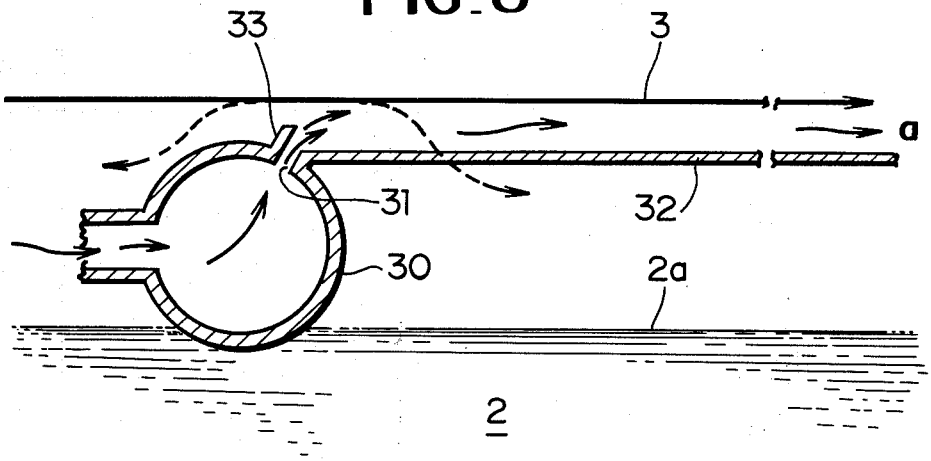
FIG. 8 is an outlined view for explaining a basic principle of a further embodiment of the invention.

FIG. 8 is to explain the basic principle of the other embodiment according to the invention, in which the numeral 3 is a strip travelling horizontally above the surface 2*a* of a bath 2, and 30 is a nozzle header and 31 is a slit outlet formed in width of the strip 30. The slit outlet 31 is elongated with a nozzle plate 32 of determined width and length in parallel with the strip 3 and having a space with respect to the lower surface of the strip 30.

When the molten metal such as Zn is spouted from the slit outlet 31 in the above condition, the molten metal collides with the face of the strip 3 and flows between the nozzle plate 32 and the strip. Thus, the strip is exactly plated only on one side. That is, in the existing process without the nozzle plate 32, the spouted molten metal is as shown with dotted line and the wet length is rather short, while in the invention having the nozzle plate 32, the wet length can be fully lengthened by increasing the supplying amount at the nozzle plate 32 than the discharging amount at "a". In such a manner, a line speed can correspond to that of the plating on two sides of the strip. In this embodiment, it is preferable to incline the slit outlet 31 to the supplying direction and provide a weir plate 33 in opposition to the nozzle plate 32 at the outlet.

For the strip edges, the nozzle header 30 and the nozzle plate 32 are prepared towards the edges of the strip 3, so that the molten metal does not turn over to the side of the strip requiring no plating.

Figure 9:
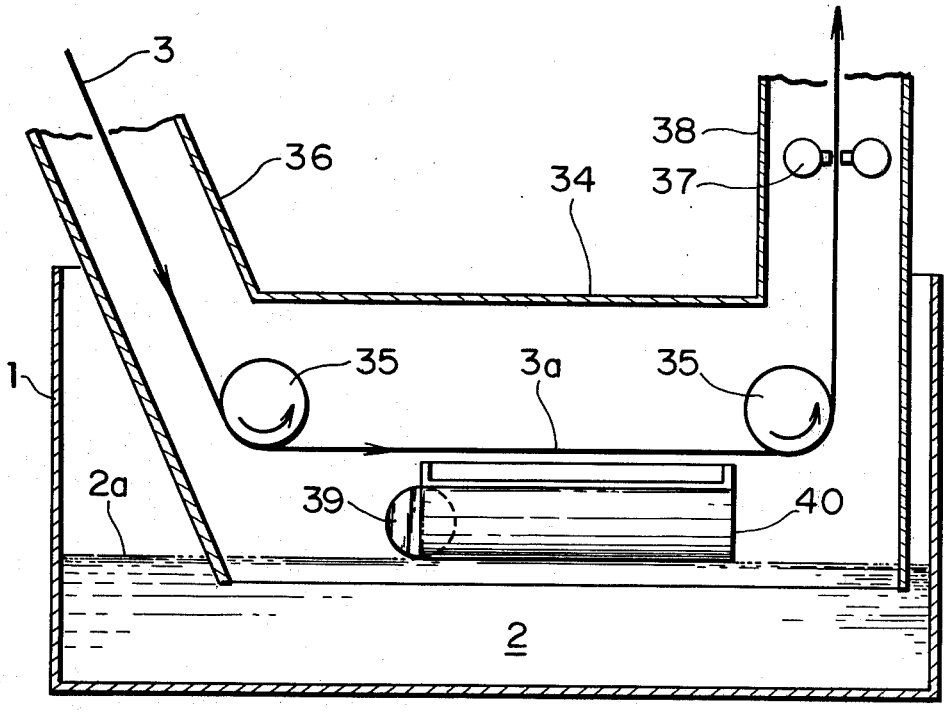
FIG. 9 is an outlined entire view showing a still further embodiment of the invention.
Figure 10:
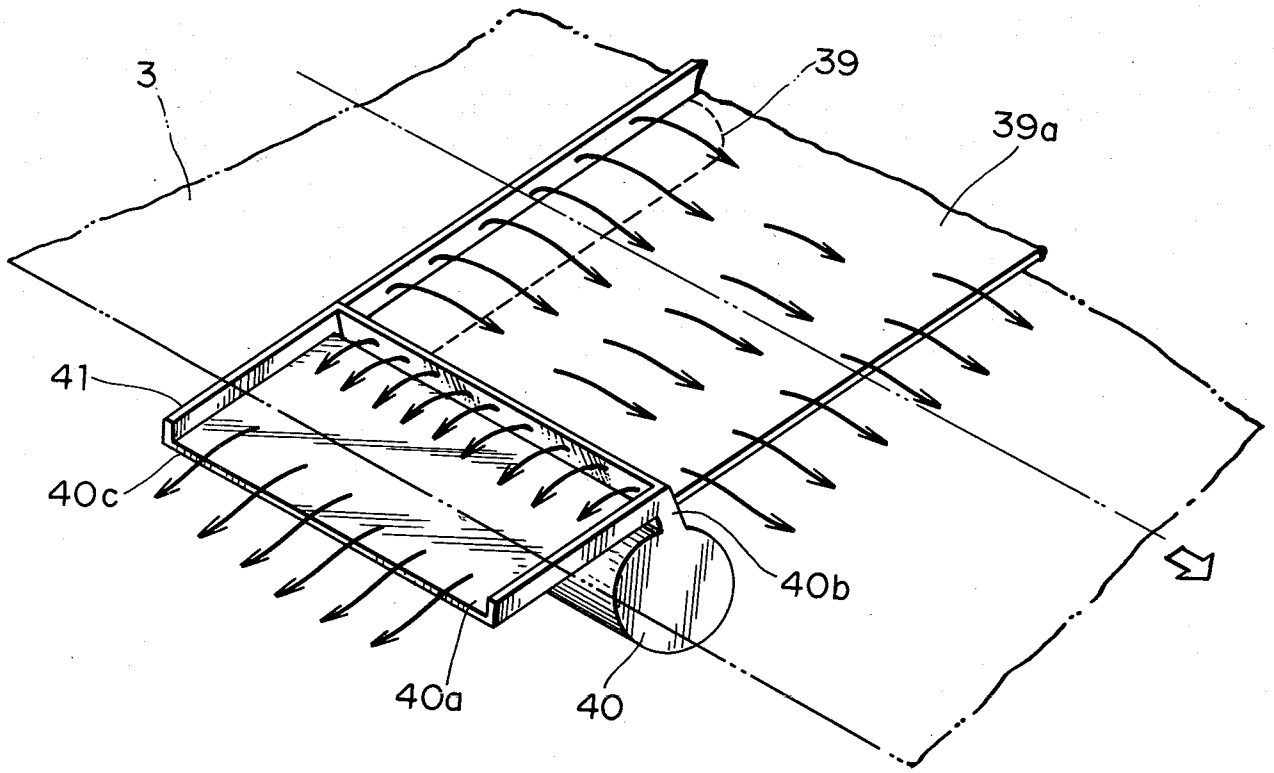
FIG. 10 is a perspective view of an element part of the above.

FIGS. 9 and 10 show one example which applies the above mentioned principle to the continuous dip-Zn plating on one side, and FIG. 9 is an outlined whole view and FIG. 10 is a perspective view of an element part, in which the numeral 1 designates a Zn plating chamber which is filled with the reducing or inert gas therein and is sheltered with a food 34, and the numeral 2 is a Zn plating bath. The strip 3 coming from an inlet 36 of the food 34 is held horizontally with respect to the still surface 2*a* of the Zn bath by means of horizontal rolls 35. The numeral 37 denotes gas wiping nozzles for controlling the amount of Zn on the strip, provided at the outlet 38 of the food 34.

On the other hand, there are installed a center nozzle 39 and edge nozzles 40 under a horizontal part 3*a* of the strip within the Zn plating chamber 1. As shown in FIG. 10 in detail, the center nozzle 39 is placed in the width of and under the strip 3, and the edge nozzles 40 are placed at the both edges of the strip (FIG. 10 shows one side thereof). These center nozzle and edge nozzle are constructed in the same in principle as shown in FIG. 10, but in the present embodiment a nozzle plate 39*a* of the center nozzle 39 is elongated in the travelling direction of the strip, and a nozzle plate 40*a* of the edge nozzle 40 is elongated in the width of the strip. Further a slit outlet 40*b* of the edge nozzle 40 is tilted about 45° to the edge of the strip, and a distance between the edge nozzles is between 50 mm and at least 550 mm for the narrowest width of the strip, and a distance between the respective nozzle plates 39*a*, 40*a* and the strip 3 is preferably 10 to 30 mm. Taking the flutterings of the travelling strip into consideration, if being less than 10 mm, the plating bath invades onto the upper surface of the strip, and if being more than 30 mm, the plating bath does not uniformly contact to the face of the strip. In this embodiment, the nozzle plate 40*a* of the edge nozzle 40 is provided with the weir plate 41, thereby to forcibly flow the molten Zn to the edge direction, which is going to flow in the strip line. A distance between the weir plate 41 and the strip 3 is preferably about 10 mm, because of the fluttering, but the strip may slightly contact to the weir as far as the properties of the weir do not hurt the strip. The Zn liquid from the nozzle plates 39*a*, 40*a* may be received directly into the plating bath 1 as conventionally, or may be once received outside of the nozzle plates.

Depending upon these embodiments, the molten Zn spouted from the center nozzle 39 flows between the lower face of the strip 3 and the nozzle plate 39*a* in the travelling direction of the strip and contacts to the central part of the lower face of the strip mainly. The molten Zn from the edge nozzles 40 contacts to the edges of the strip mainly.

Basing on these examples, the experiment was carried out in the under condition with a result of providing the uniform plating on the one-side of the steel sheet without any invasion to the upper face of no plating. The operation could be performed without changing the positions of the nozzles and the amount of supplying the molten metal in response to variations of the strip width. The line speed in this experiment was 150 mpm.

TABLE 3

| | Size of Outlet | Flow amount |
|---|---|---|
| Center nozzle | 10mm × 500mm | 89 L/min |
| Edge nozzles | 10mm × 1500 mm | 266 L/min × 2 |
| | Width of plate: 600 to 1500mm | |

Figure 11:
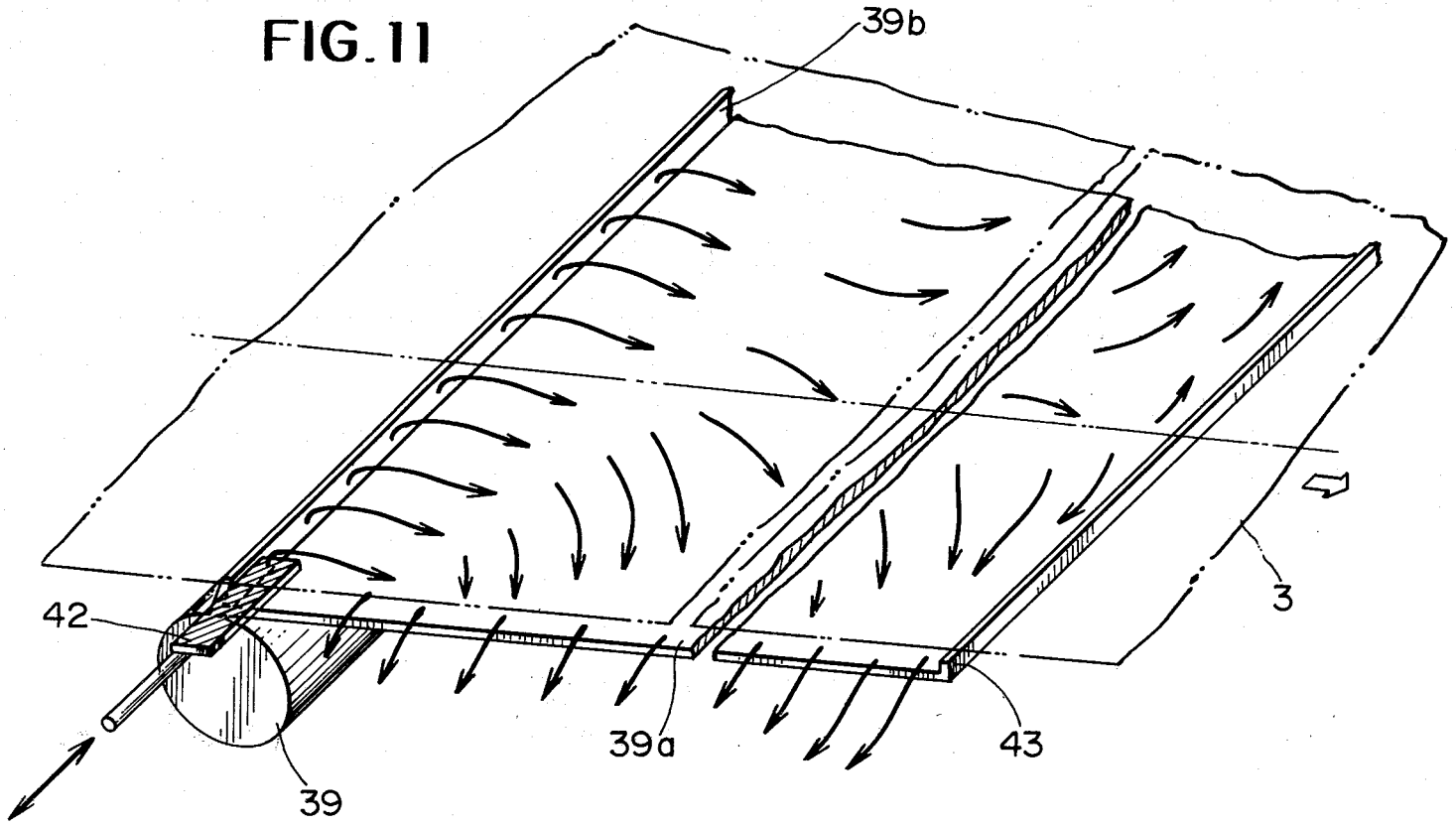
FIG. 11 and FIG. 12 are perspective views alternations in FIG. 10, and, FIG. 13 is a cross sectional view seen from C—C line in FIG. 12.

FIG. 11 shows an improvement of the above mentioned embodiment, in which a nozzle mask 42 is slidably provided at both edges of the slit outlet 39*b* of the center nozzle 39. The nozzle mask 42 is automatically moved in width in accompany with changings of the strip widths for controlling the slit outlet 39*b* to a determined length of an opening. Weir plates 43 are furnished at the outer edges of the nozzle plate 39*a* in the flowing direction, thereby to change the flow from the line direction to the width direction.

In this embodiment, the nozzle mask 42 exactly avoid said invasion in spite of alternations of the strip width, so that the plating on the one side can be provided with one center nozzle only.

The experiment was carried out of this embodiment in the under condition with the same result as in the above experiment.

TABLE 4

| | Size of outlet | Flow amount |
|---|---|---|
| Center nozzle | 10mm × 1500mm | 266 L/min |
| | Width of plate: 600 to 1500mm | |

Figure 12:
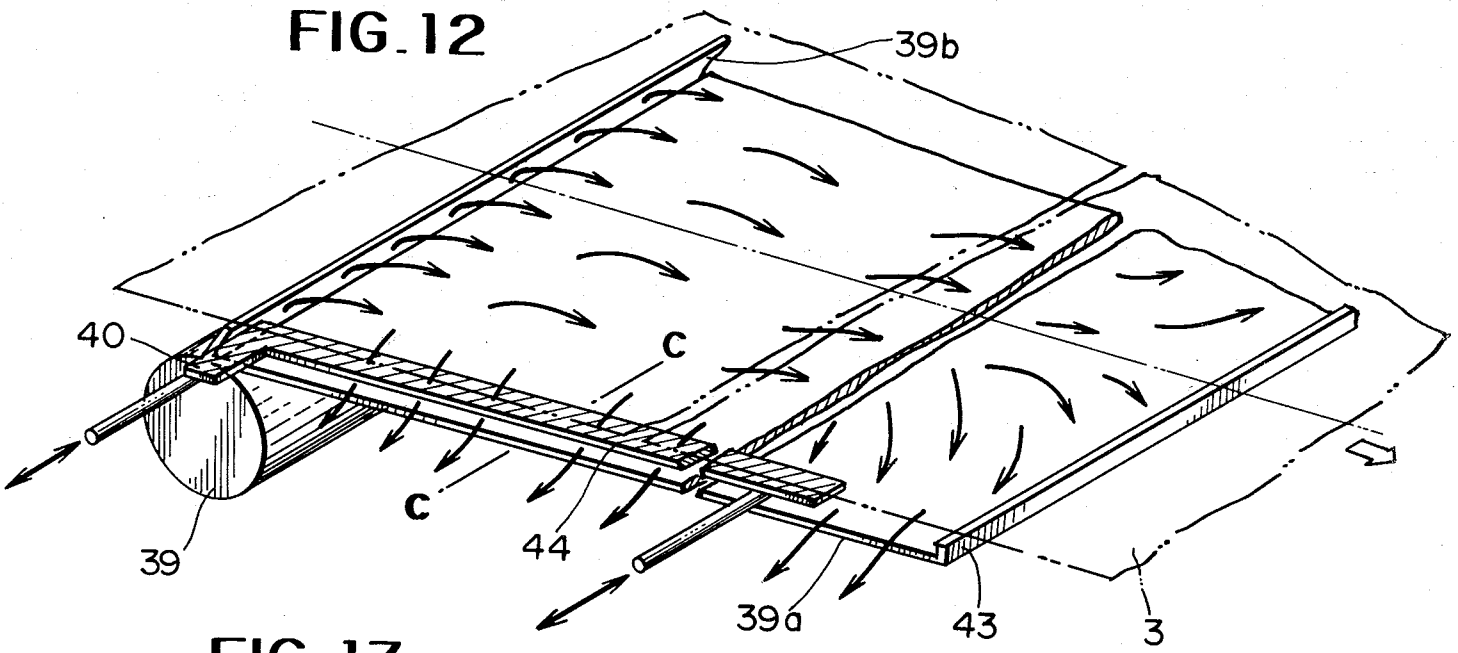

FIG. 12 shows an improvement of the embodiment in FIG. 11, in which edge masks 44 are provided under the both edges of the strip to check leakage of the molten Zn from the strip edge and positively flow it in the line direction for an aim of lengthening the wet length. The edge mask 44 of this embodiment is integral with the above said nozzle mask 42, and automatically follows the changings of the strip width.

Figure 13:
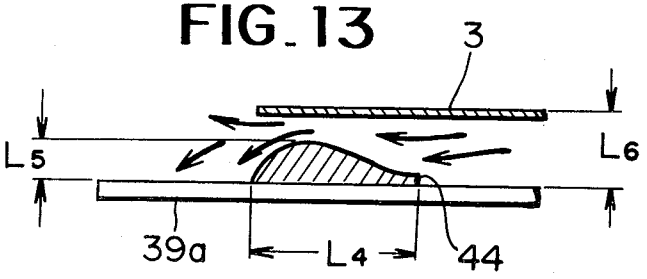

FIG. 13 is a cross section seen from C—C in FIG. 12, in which the cross sectional shape of the edge mask 44 is high toward the strip edge, so that the Zn flowing path is squeezed between the strip 3 and the edge mask 44. Thereby, the Zn flowing out is largely reduced to enable Zn to supply to the line direction with good efficiency and also to the edge parts. In the present embodiment, a width ($L_4$) of the edge mask 44 is about 50 mm, and the maximum height ($L_5$) from the nozzle plate 39*a* is about 5 mm (a distance ($L_6$) between the nozzle plate and the strip is 10 mm). The wet length is about 1.5 times in the same flowing condition as the embodiment in FIG. 11, and the line speed is possible up to 200 mpm.

The above mentioned embodiments are a few of examples, and for example, the nozzle plate is not limited to the shown ones, and as far as the plate is parallel to the face of the strip, the details of the mechanisms can be altered in response to the demands. Further, the present invention can be applied not only to the continuous dip-Zn plating on one side of the strip but also to the general continuous molten metal plating on the one side.

We claim:

1. A continuous dip-plating process for plating one side of a steel strip, wherein said strip travels substantially horizontally over a still surface of a plating bath, while said plating bath is spouted onto said one side of said strip, and wherein a plating flow is provided along the edges of said strip in a widthwise direction outwardly from said edges, and a plating flow is provided along the central part of said strip in a lengthwise direction.

2. The process of claim 1, wherein said plating bath flowing at said central part flows at a rate of more than 1.2 m/sec.

3. The process of claim 1, wherein said plating bath flows at the edges at a rate faster than 1.5 to 2.0 times that at the central part of said strip.

* * * * *